United States Patent [19]

Hempel

[11] 4,280,473

[45] Jul. 28, 1981

[54] FIREPLACE HAVING OUTSIDE AIR SUPPLY

[75] Inventor: Rodney A. Hempel, Huntington, Ind.

[73] Assignee: American Standard Inc., New York, N.Y.

[21] Appl. No.: 973,416

[22] Filed: Dec. 26, 1978

[51] Int. Cl.[3] ..... F24B 1/18; F24H 3/00

[52] U.S. Cl. ..... 126/120; 126/139; 126/121; 126/112; 237/51

[58] Field of Search ..... 126/120, 121, 129, 131, 126/135, 138, 139, 103, 112, 163 R, 143; 237/51

[56] References Cited

U.S. PATENT DOCUMENTS

| | | | |
|---|---|---|---|
| 921,019 | 5/1909 | Speer | 126/112 |
| 1,625,556 | 4/1927 | Lomshakoff | 126/163 R |
| 4,004,731 | 1/1977 | Zung | 237/51 |
| 4,061,127 | 12/1977 | Fisher | 126/120 |
| 4,095,581 | 6/1978 | Billmeyer et al. | 126/121 |
| 4,117,827 | 10/1978 | Billmeyer | 126/121 |
| 4,170,219 | 10/1979 | Hansen et al. | 121/121 |
| 4,179,065 | 12/1979 | Zung | 237/51 |
| 4,185,612 | 1/1980 | Briner et al. | 126/121 X |

*Primary Examiner*—James C. Yeung
*Assistant Examiner*—Larry Jones
*Attorney, Agent, or Firm*—James J. Salerno, Jr.; Robert G. Crooks

[57] ABSTRACT

An outside air system and combustion chamber closure assembly for use with a fireplace which provides means for supplying sufficient amounts of cooling air between the burning fuel and the closure assembly is disclosed. The closure assembly includes a frame surrounding the combustion chamber opening and at least one door operably mounted thereto. A grille is formed in the bottom rail of the frame for introduction of air into the combustion chamber. The outside air system includes an outside air duct which is coupled to a chamber defining an air plenum formed below the hearth of the fireplace and air cap assembly. The air cap assembly is positioned against the bottom rail of the frame and extends across the combustion chamber opening. The assembly includes a duct which communicates with the chamber defining the air plenum formed below the hearth and an air discharge housing positioned adjacent the bottom rail. A damper means is operably mounted in the air discharge housing and is adjustable between an outside air mode or a room air mode so that when said at least one door is closed, only outside air or room air will pass into the combustion chamber at hearth level in sufficient volume for fuel combustion as well as providing an excess of air to prevent overheating of the fireplace assembly and said at least one door.

8 Claims, 13 Drawing Figures

10
26
20
18
17
80
25
6
50
30

FIREPLACE HAVING OUTSIDE AIR SUPPLY

BACKGROUND OF THE DISCLOSURE

This invention relates to an outside air system and combustion chamber closure assembly which provides means for supplying a sufficient amount of cooling air between the burning fuel and the combustion chamber closure assembly.

Fireplace closure assemblies are known, for example, U.S. Pat. Nos. 3,372,689, 3,870,032, 3,995,612 and 4,029,076. Outside air duct assemblies for fireplaces are also known, for example, U.S. Pat. Nos. 4,059,090, 4,061,127, 4,004,731 and 3,910,251. Many problems and disadvantages are encountered when utilizing an outside air duct assembly and a fireplace closure assembly, particularly when glass doors are used. Glass enclosures prevent sufficient amounts of air from entering the combustion chamber for the combustion of fuel and do not provide the necessary amounts of cooling air to prevent overheating of the fireplace and damage to or destruction of the glass panels.

Prefabricated fireplaces are designed and tested using fixed amounts of fuel input in accordance with the air flow through the frontal opening of the firebox or chamber. If flow of air is reduced by employing a glass enclosure system while maintaining the same fuel combustion rate, the fire chamber as well as the chimney temperatures will exceed the design capacity and may destroy or damage the glass enclosure assembly and may render the fireplace and chimney assembly unsafe.

Another disadvantage encountered when using a glass enclosure is the loss of radiant energy which would normally be radiated to the room as useful heat.

Fireplace designs which utilize an outside air system and a combustion chamber closure assembly provide combustion air either through the hearth or through one of the combustion chamber walls and may not be capable of providing sufficient amounts of air for fuel combustion as well as an excess of cooling air to prevent overheating of the fireplace with resultant damage to the closure assembly and fireplace itself.

SUMMARY OF THE INVENTION

It is an object of the invention to provide an outside air system and combustion chamber closure assembly for use with a fireplace which provides means for supplying sufficient amounts of cooling air between the burning fuel and the closure assembly to prevent overheating and/or damage to the closure assembly.

It is another object of the invention to provide a prefabricated fireplace assembly which includes an outside air system and glass closure assembly in which the glass doors are capable of withstanding extreme burning conditions without attendant damage to the glass panels.

It is another object of the invention to provide an outside air conduit system which includes an air cap and damper assembly which, when the glass doors of the closure assembly are closed, is capable of directing either outside air or room air into the combustion chamber upwardly and across the combustion chamber opening to provide sufficient amounts of air to burn the fuel and to prevent overheating of the closure assembly by radiant heat from the burning fuel.

It is another object of the invention to provide an outside air duct having a height of ten feet above the hearth while preventing a secondary chimney effect.

A further object of the invention is to provide a prefabricated fireplace assembly having an outside air and closure assembly which is capable of maintaining safe firebox and flue temperatures at designed fueling rates for the fireplace and chimney assembly and which prevents radiant heat damage to the closure assembly.

It is another object of the invention to provide a fireplace design which is safe, and can be used in mobile homes or in rooms where the volume of air is to be adjusted to minimize room air looses while maintaining safe fireplace and glass panel temperatures.

It is another object of the invention to provide a flow of air which will always feed the combustion chamber at hearth level in sufficient amounts to prevent radiant heat damage to the glass doors while providing sufficient amounts of air for the burning fuel and to maintain the temperature of the glass panels below 550° F., the thermal point at which most types of heat treated glass lose its tempering.

Another object of the invention is to provide a fireplace design having an outside air and closure assembly and which is capable of returning heat energy to the room which normally would be lost through the chimney.

A further object of the invention is to provide an outside air system and closure assembly which is economical, relatively easy to manufacture, and is capable of being mounted to standard prefabricated fireplace units.

The invention generally contemplates providing an outside air system and combustion chamber closure assembly for use with a fireplace which provides means for supplying sufficient amounts of cooling air between the burning fuel and the closure assembly. The closure assembly includes a frame surrounding the combustion chamber opening and at least one door operably mounted thereto. A grille is formed in the bottom rail of the frame for the introduction of outside or room air into the combustion chamber. The outside air system includes an outside air duct which is coupled to a chamber defining an air plenum formed below the hearth of the fireplace and an air cap assembly. The air cap assembly is positioned against the bottom rail of the frame and extends across the combustion chamber opening. The assembly includes a duct which communicates with the chamber defining the air plenum formed below the hearth and an air discharge housing positioned adjacent the bottom rail. A damper means is operably mounted in the discharge housing and is adjustable between an outside air mode or a room air mode so that when said at least one door is closed only outside air or room air will be introduced into the combustion chamber at hearth level, whereby air flows upwardly against the combustion chamber side of said at least one door and between the burning fuel so that said at least one door is maintained at a relatively low temperature. An ash filter basket assembly is provided for collecting any debris that may inadvertently be entrapped or forced into the outside air system.

DESCRIPTION OF THE PREFERRED EMBODIMENT

Figure 1:
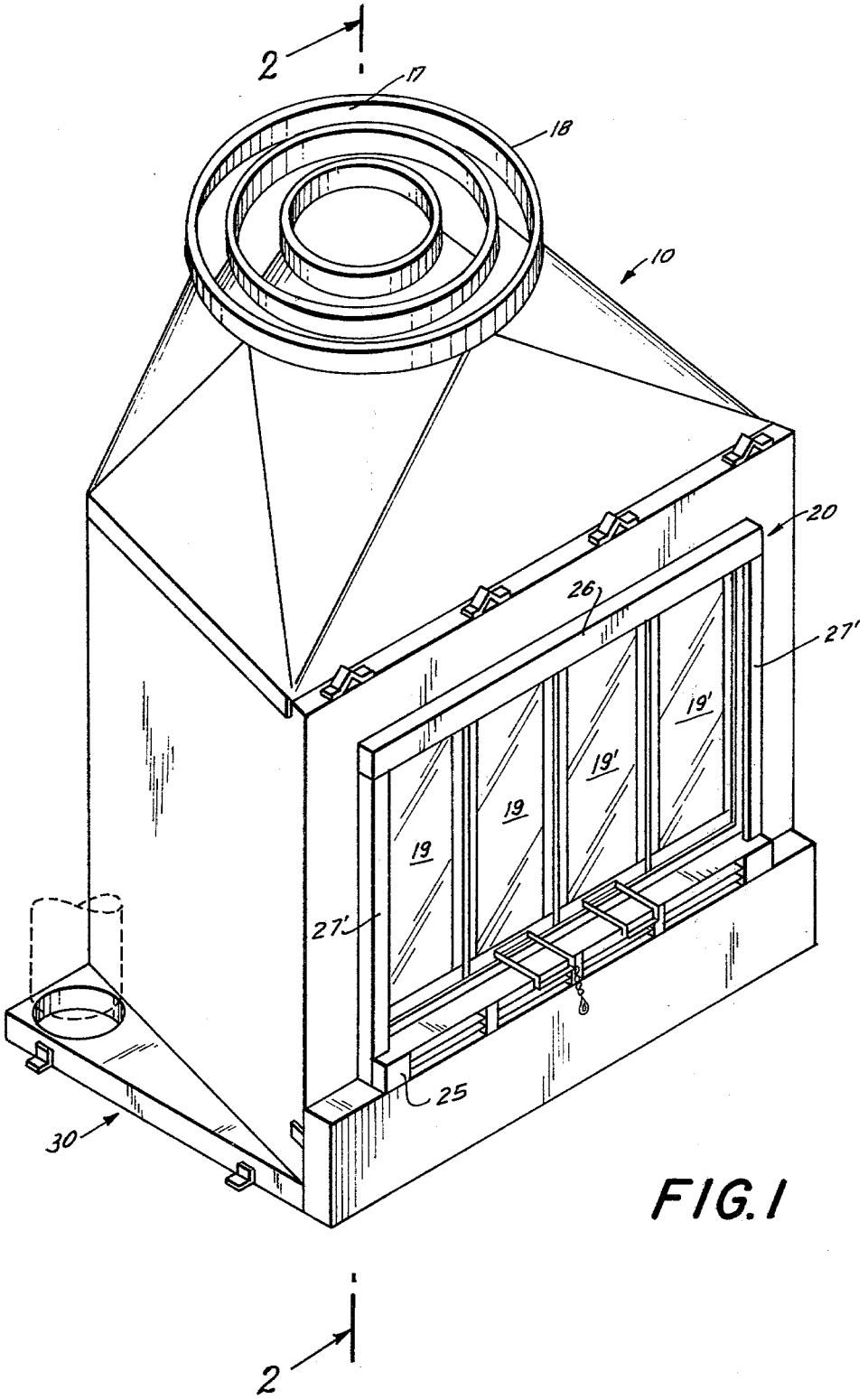
FIG. 1 is an isometric view of a fireplace design incorporating the outside air system and combustion chamber closure assembly of the invention herein.
Figure 2:
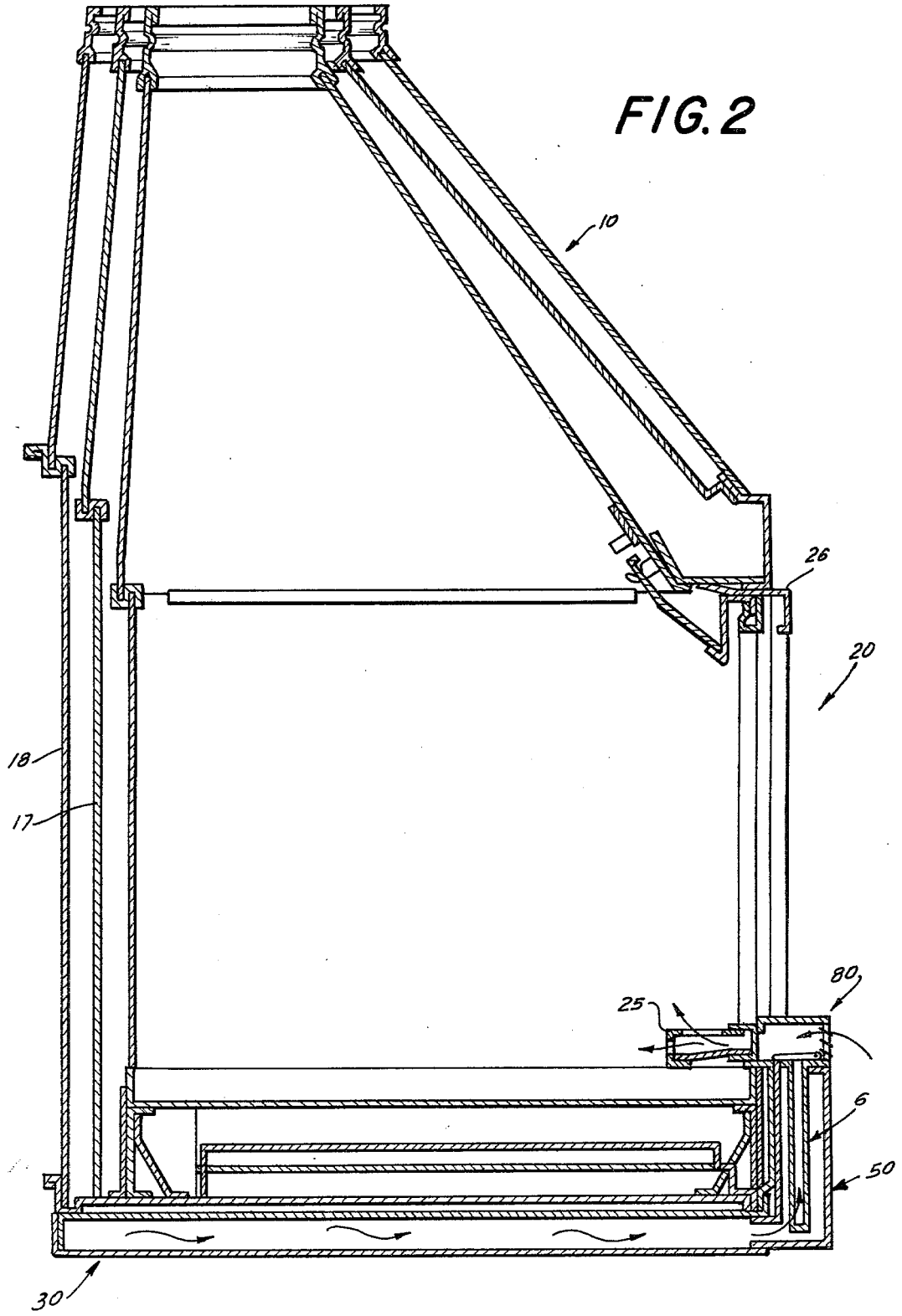
FIG. 2 is a vertical transverse section taken along the line 2—2 of FIG. 1.

The outside air system 30 and combustion chamber closure assembly 20 of the present invention is illustrated operatively mounted in position in FIGS. 1 and 2 on fireplace 10. Fireplace 10 is of the prefabricated type such as is shown in U.S. Pat. No. 2,821,975. Fireplace 10 includes a combustion chamber 12 having closure assembly 20 mounted across the opening thereof. Fireplace 10 is provided with an intermediate fireplace casing 17 surrounding the combustion chamber 12 and spaced therefrom so as to leave an air space between them, and outer fireplace casing 18 which in turn surrounds intermediate fireplace casing 17 and is spaced therefrom so as to leave an air space between them. Fireplace 10 is coupled to a thermosiphonic chimney not shown, having certain features in common with the chimney disclosed in U.S. Pat. No. 2,634,270. The thermosiphonic chimney carries combustion products away from the fireplace and also provides an air stream which cools the combustion chamber of the fireplace as well as the flue and other components of the thermosiphonic chimney.

Figure 11:
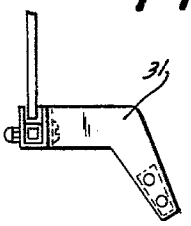
FIG. 11 is a side elevational view of a handle shown in FIG. 10.

Combustion chamber closure assembly 20 includes a frame 21 illustrated in FIGS. 8–11 and includes a pair of bifold doors 19, 19'. Bifold doors 19, 19' are hingedly connected and when opened, one set of bifold doors are positioned in stacked relation on each side of the chamber opening. Frame 21 is mounted in the combustion chamber 12 around its opening as seen in FIG. 1 Frame 21 includes top and bottom rails 22, 22' and left and right vertical rails 23, 23'. An angle bracket 24 is mounted to top rail 22 to provide means to mount a screen assembly in the opening, not shown, of combustion chamber 12. A channel shaped louvered grille or rail 25 is positioned on the hearth and across the combustion chamber opening. Bottom rail 22' is mounted on grille 25 as by spot welding or pop rivets or the like. Top decorative panel 26' and left and right vertical decorative panels 27, 27' are likewise mounted to frame 21 as by spot welding, pop rivets or the like. Louvered grille 25 forms part of the outside air system 30 and provides air conduit means for introducing air into the combustion chamber at hearth level. Left and right spring brackets 28, 28' are mounted on left and right vertical rails and provide hinge means for pivotally mounting bifold doors 19, 19' on vertical axles 29, 29'. Vertical pins 11, 11' are mounted on the top and bottom outside corners and are slideably mounted in the channels of top and bottom rails 22, 22'. Handles 31, 31' are mounted on the bottom frame of bifold doors 19, 19' as by threaded bolts as shown in FIG. 11. Handles 31, 31' are positioned such that they are below the level of the burning fuel and do not become overheated by radiant heat from the fire either when the doors are opened or closed.

Outside air system 30 is illustrated in FIGS. 2 through 7. Outside air system 30 includes outside air ducts 32 having outside air openings 33 which are fitted with outside air caps 34 each having a wire mesh or screen 35 mounted across each outside air openings 33. Screens 35 prevent loose objects and/or animals from accidentally entering the outside air system. Outside air ducts 32 may include two 90° elbows and extend up to 10 feet in any direction relative to the hearth of the fireplace, and may even extend vertically without causing a secondary chimney effect.

Figure 4:
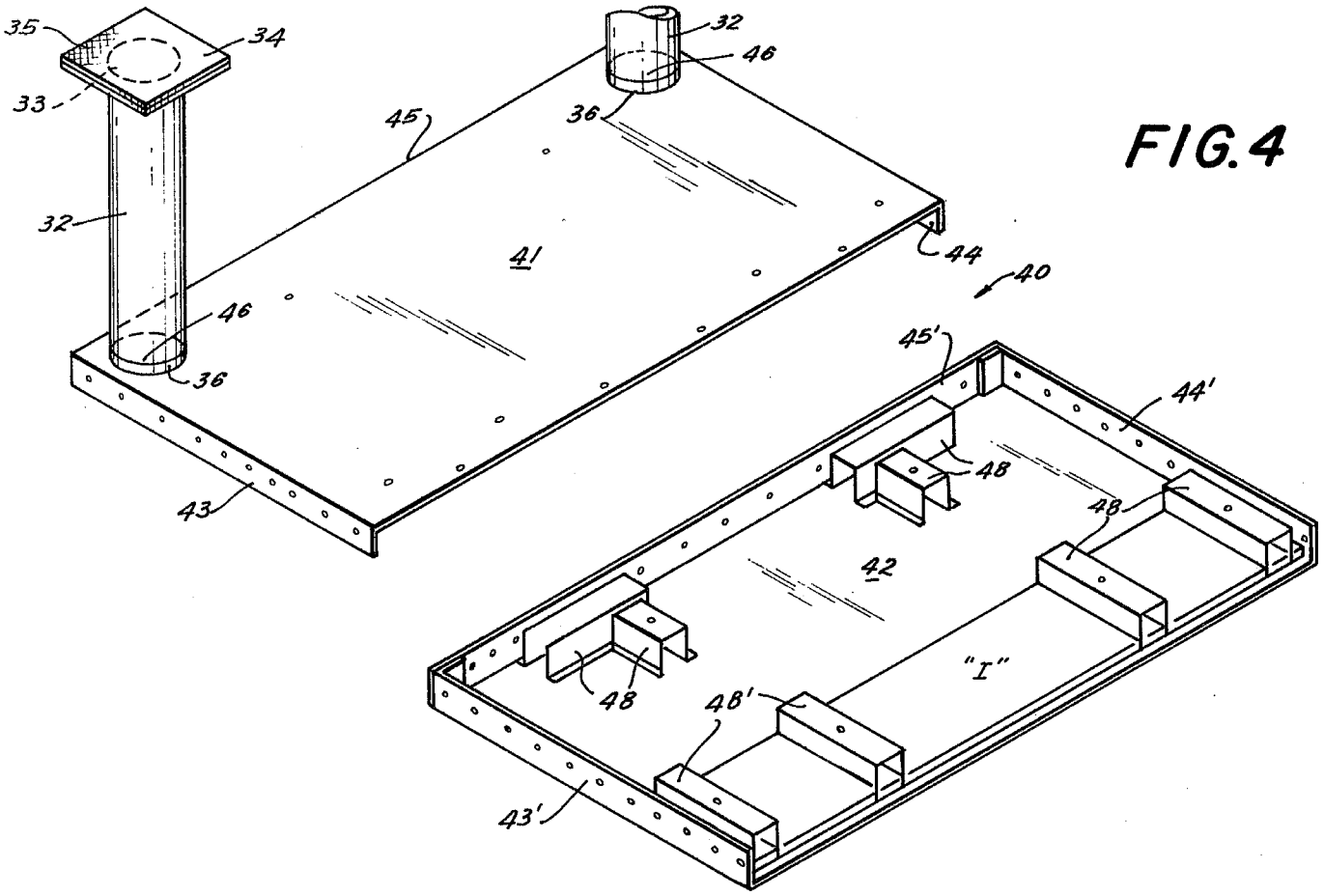
FIG. 4 is an exploded isometric view of the outside air duct and air chamber adapted to be mounted below the hearth of a fireplace.

A bottom pan assembly 40, shown in exploded isometric view in FIG. 4, is box-like and includes a pair of complementary sections 41 and 42. Top section 41 is formed with depending side walls 43, 44 and 45 respectively. Top section 41 is provided with two openings 46 for mounting other end 36 of outside air duct 32 therein. Bottom section 42 also includes complementary side walls 43', 44' and 45'. The complementary sections 41 and 42 when mounted together are joined by pop rivets or any other suitable fastening means so as to provide a chamber defining air plenum 47. Section 42 includes a plurality of spaced braces 48, 48' preferably spot welded to section 42 and when bottom pan 40 is assembled the braces provide support means for the fireplace 10 when mounted thereon.

Figure 3:
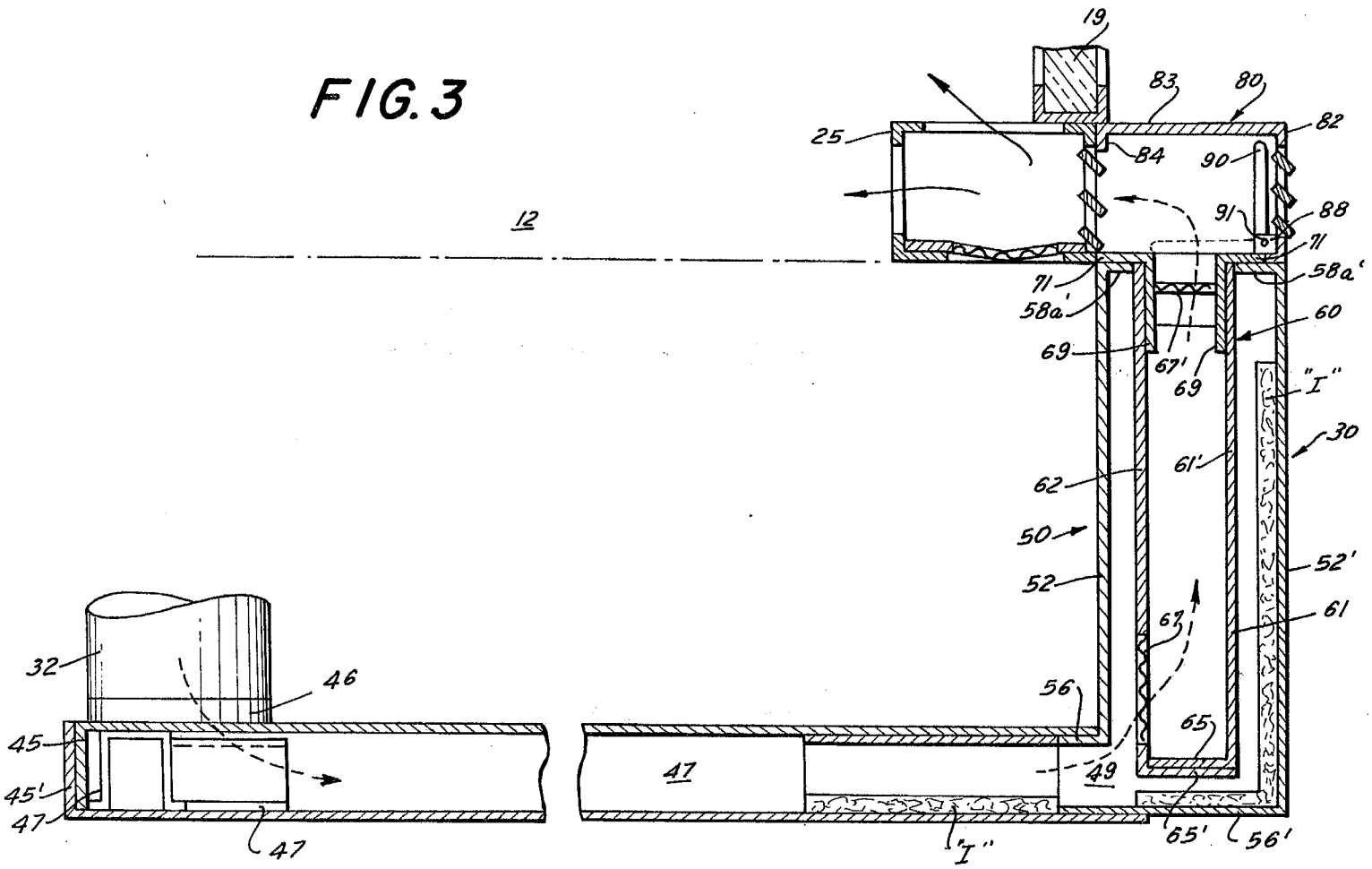
FIG. 3 is an enlarged fragmentary sectional view of the outside air system and combustion chamber closure assembly partially broken away with the hearth of the fireplace shown in phantom.
Figure 5:
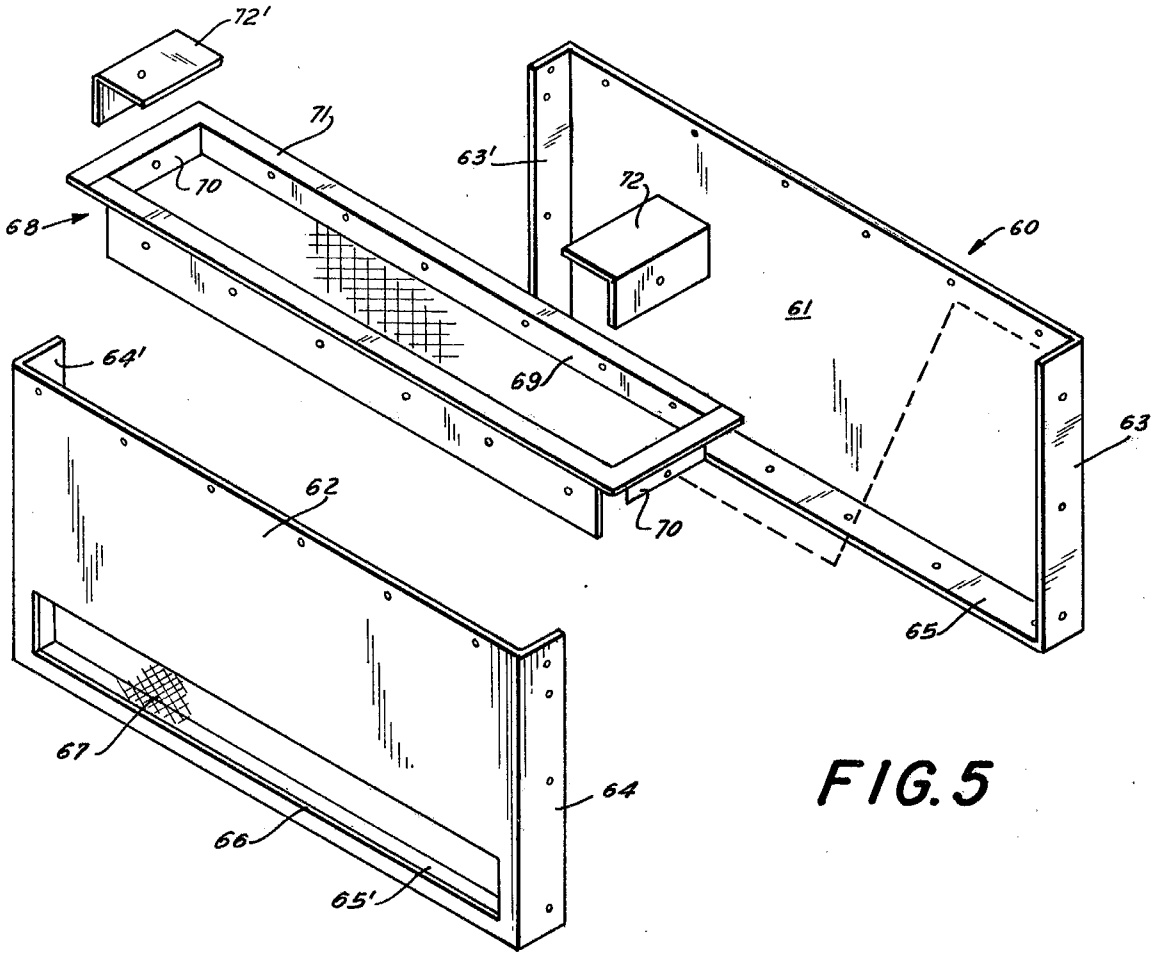
FIG. 5 is an exploded isometric view of the box assembly or duct adapted to be mounted to one end of the air chamber of FIG. 4.

Box assembly 50 is illustrated in an exploded isometric view in FIG. 5 and is shown fully assembled in FIG. 3 as an integral section of outside air system 30. Box assembly 50 includes a pair of vertical side walls 52, 52' and a pair of end walls 54, 54'. End walls 54, 54' are L-shaped with the lower portion of the "L" being of a width substantially equal to the height of bottom pan assembly 40. End walls 54, 54' have vertical inturned flanges 54*a*, 54*a*' and 55*a*, 55*a*' so that side walls 52, 52' will butt thereagainst at its vertical edges 55, 55' and be held in position by pop rivets, not shown. Side wall 52 is formed having horizontal flanges 51 at each of its lower vertical ends so that flanges 51 will nest against correpsonding flanges 51*a* and 51*a*' of end walls 54, 54'. Box assembly 50, is mounted to bottom pan assembly 40 along its open side such that the lower L-shaped section of box assembly 50 forms a junction 49 for the continuation of plenum 47 of outside air system 30. Top plates 58, 58' are mounted to the top edges of end walls 54, 54' and extend inwardly along the top edges of side walls 52, 52' to define a rectangular opening for ash filter basket assembly 60 shown in exploded isometric view in FIG. 5 and as an integral section of outside air system 30, shown in FIG. 3. Side walls 52, 52' are formed having inturned flanges 58a and 58a' to provide a seating lip for ash filter basket assembly 60. Insulation "I" is mounted on the inner surface of wall 42 of bottom pan assembly 40 and vertical wall 52' of box assembly 50 as shown in FIG. 3.

Basket assembly 60 includes a pair of vertical side walls 61, 62, each side wall having complementary vertical flanges 63, 63' and 64, 64' and bottom flanges 65, 65' so that when basket assembly 60 is coupled together to form a box, flanges 63, 63', 64, 64' and 65, 65' are in nesting relation and held together with pop rivets, not shown. A rectangular slot or opening 66 is formed in side wall 62 and is covered by screen 67 so that air can be conducted through basket 60 from air plenum 47 and junction 49. The open upper end of basket 60 is fitted with a cover 68 having a flat outer rim 61 with depending flanges 69 that correspond in length approximately to the width of side walls 61 and 62. Depending end flanges 70 of rim 71 correspond in width to flanges 63, 63', 64, 64'. A screen 67' horizontally mounted in rim 71 is positioned adjacent top edge thereof. Rim 71 nests on the horizontal flanges 58a, 58a' and top plates 58, 58' of box assembly 50. A pair of angles or brackets 72, 72' are riveted on the end of walls 63, 64 and 63', 64' of basket 60 and extend across rim 71 of cover 68 so that the ash basket can be removed for cleaning of any debris contained therein.

Figure 6:
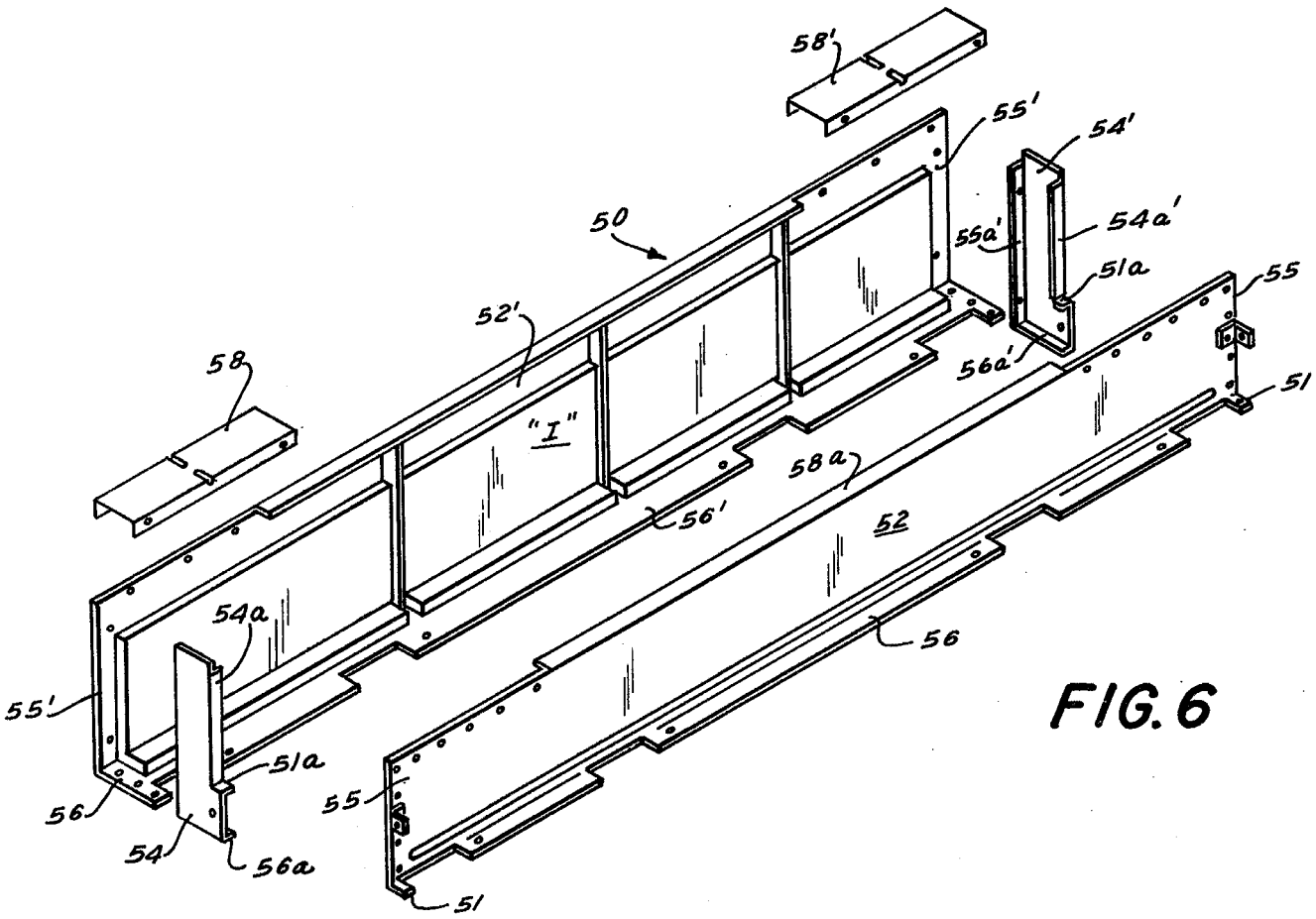
FIG. 6 is an exploded isometric view of the ash filter basket adapted to be removably mounted within the duct of FIG. 5.
Figure 7:
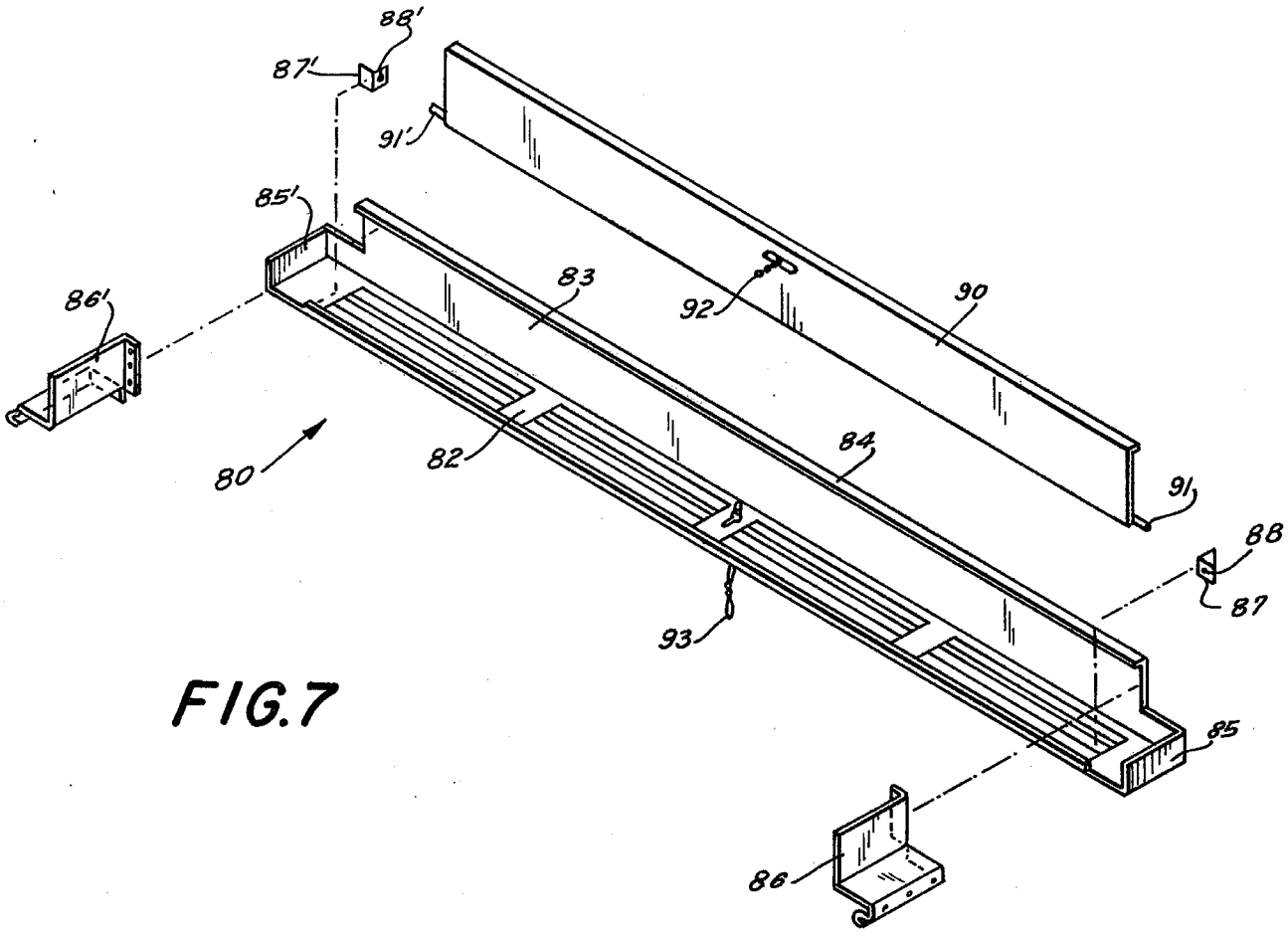
FIG. 7 is an exploded isometric view of the discharge housing and damper assembly adapted to be mounted on the duct of FIG. 5.
Figure 8:
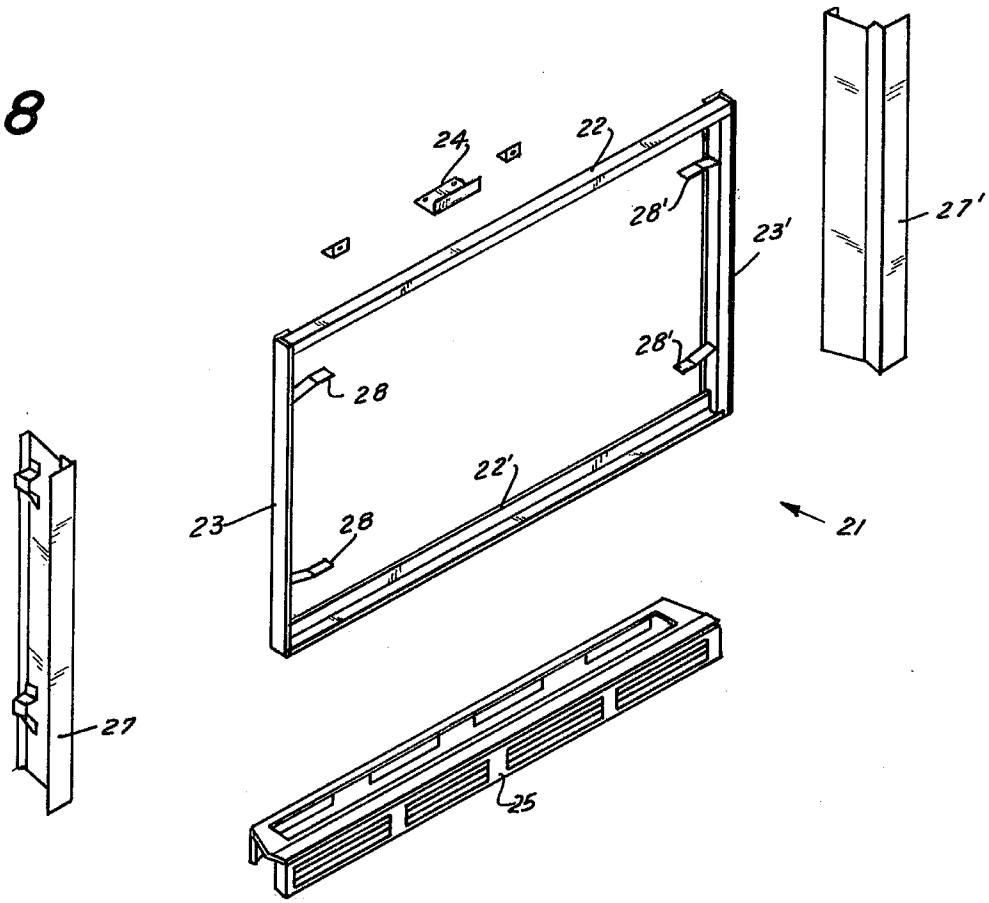
FIGS. 8 and 9 are exploded isometric views of the frame and glass closure assembly.
Figure 9:
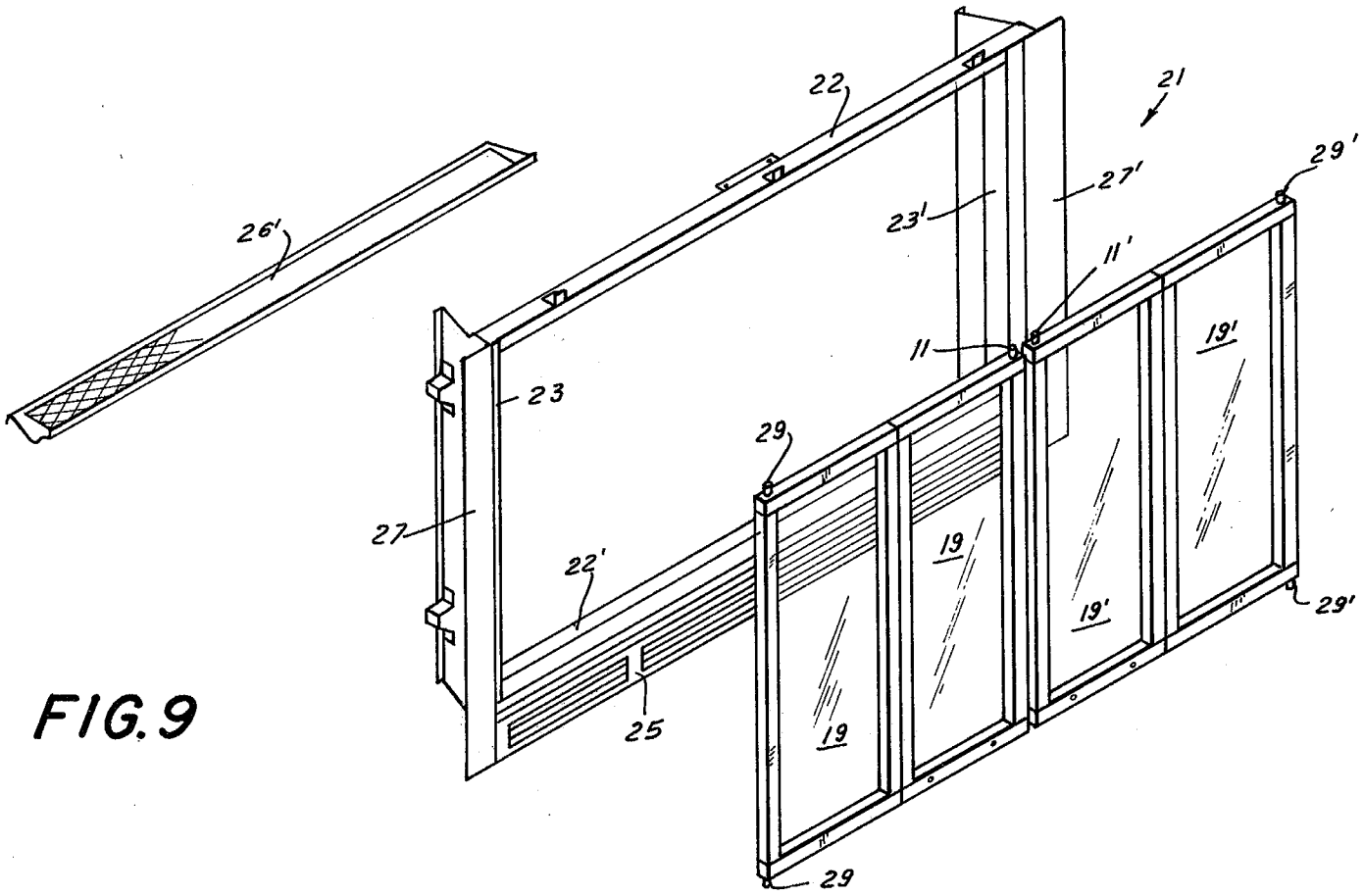
Figure 10:
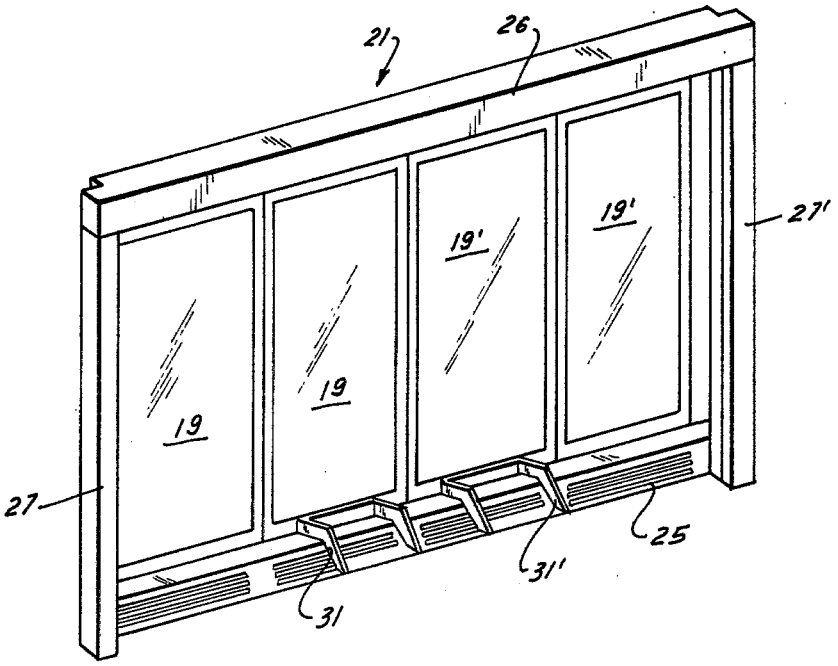
FIG. 10 is an isometric view of the frame and glass closure assembly fully assembled and adapted to be mounted on the fireplace assembly shown in FIG. 1.

Air discharge housing 80 shown in FIG. 7 is an exploded isometric view and has been rotated 90° to clearly illustrate all parts. As shown in FIGS. 3 and 6 air discharge housing is mounted on box assembly 50 in slots 58, 58' and nests against the outer surface of louvered grille 25 of frame 21 so that an outside air passageway is provided from outside air duct 32 and combustion chamber 12 shown by the direction of the arrows in FIGS. 2 and 3. Air discharge housing 80 includes a louvered vertical wall or grille 82 which extends the width of combustion chamber 12 and top wall 83 is formed integrally with louvered wall 82. Top wall 83 is formed having depending flange 84 which butts against louvered grille 25 of frame 21 as shown in FIG. 3. Vertical end flanges 85, 85' are turned inwardly toward frame 21. Side brackets or clips 86, 86' are L-shaped and are spot welded to flanges 85, 85' to form end enclosure of air discharge housing 80 when mounted on the open outer end of duct 50. Angle brackets 87, 87' having openings 88, 88' are mounted on louvered wall 82 on its inner surface and provide mounting means for damper 90. Axle or rod-like protrusions 91, 91' are integrally formed on damper 90. Damper 90 extends the width of louvered wall 82 and is pivotally mounted on axle 91 in openings 88, 88' of angle brackets 87, 87'. Handle 93 is fitted on chain 92 and is slideably mounted thereon at one end. The other end of chain 92 is passed through key slot opening 81 formed in louvered wall 82 and is removably mounted on damper 90 by any convenient means. Chain 92 permits shifting of damper 90 between an outside air mode position shown in FIG. 3 or a room air mode position shown in dotted lines of FIG. 3. As depicted in FIG. 2, the direction of the arrows illustrate damper 90 in the room air mode position. Air enters the combustion chamber through grille 82, louvered grille 25 of the closure assembly 20 and into the combustion chamber 12 at hearth level so that room air flows upwardly between the glass doors and the burning fuel. As depicted by the direction of the arrows in FIG. 3, damper 90 is in the outside air mode position so that outside air is drawn in through air duct 32 through bottom pan assembly 40, into the lower end of box 50 and into ash basket assembly 60, through louvered grille 25 formed in the bottom rail of the glass enclosure frame 21 and into combustion chamber 12 at hearth level so that outside air flows upwardly between the glass doors and the burning fuel. When the flow of air is introduced at hearth level and below the fire, i.e. the burning fuel, it follows natural convection air currents established in the fire thermal lift region. Sufficient air is fed to fire to burn the fuel and that the excess cooling air is directed against the combustion chamber side of the glass panels. This cooling air enables the glass to maintain a temperature below 550° F., the temperature at which glass loses its tempering and prevents damage by radiant heat to the closure assembly. Also the damper will always be either in the outside air mode of room air mode so that the flow of air into the combustion chamber will always be sufficient to prevent overheating of the fireplace.

Figure 12:
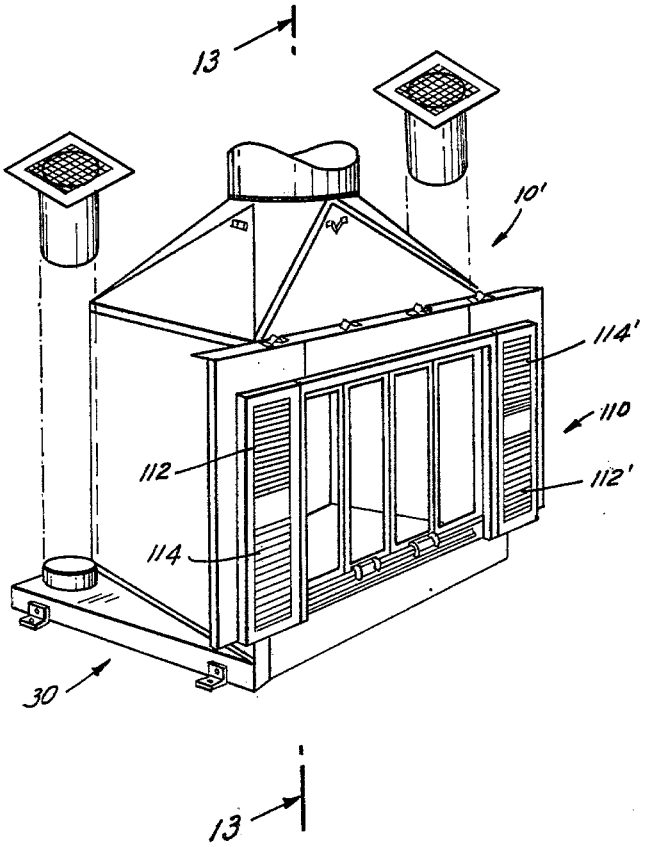
FIG. 12 is an isometric view of a prefabricated fireplace of energy saving type and embodying the outside air and closure assembly of the invention herein.
Figure 13:
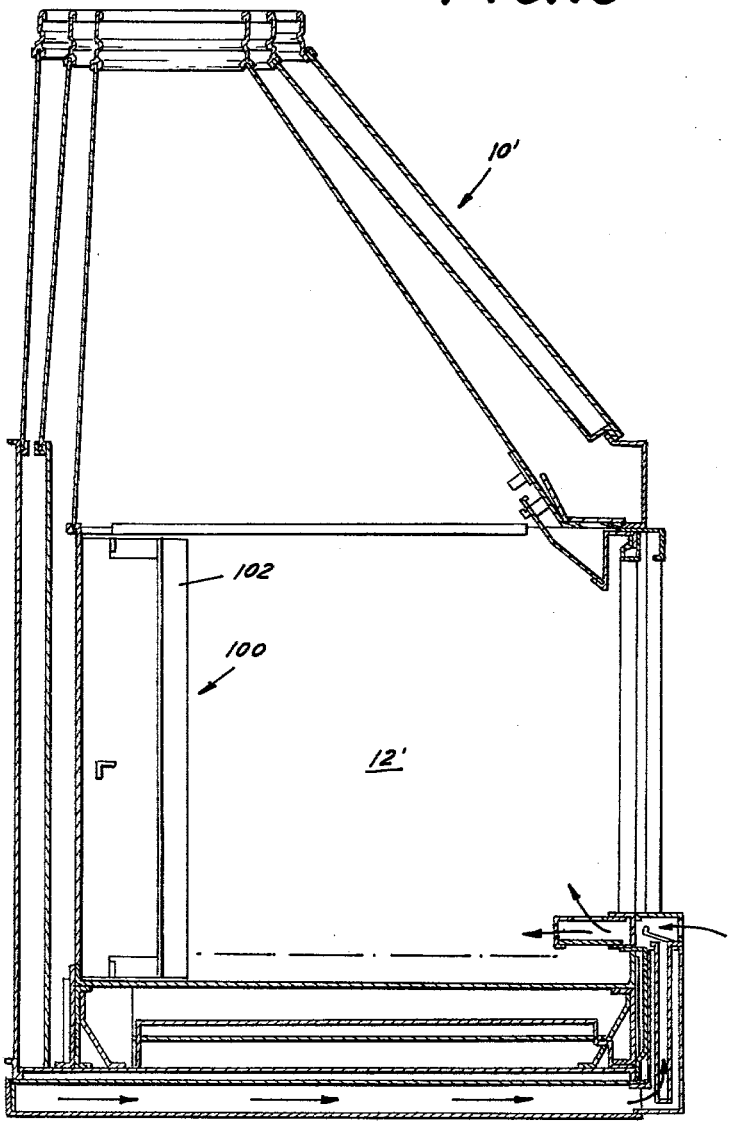
FIG. 13 is a sectional elevational view of a fireplace assembly taken along lines 13—13 of FIG. 12.

FIGS. 12 and 13 illustrate an alternate form of the fireplace assembly embodying the invention herein. FIG. 12 depicts a fireplace assembly 10' such as is described and illustrated in U.S. patent application of Clifton Briner and Rodney Hempel, Ser. No. 856,713 filed Dec. 2, 1977 for Heat Circulating Fireplace. Fireplace 10' includes a heat exchanger assembly 100 operably coupled to an air conducting assembly 110 which are arranged and constructed to recover and utilize substantial quantities of heat energy which normally would be expelled to the outside atmosphere via the chimney flue. The operation of air conducting assembly 110 and heat exchanger assembly 100 when operably mounted in fireplace 10' is described in the aforementioned U.S. patent application. Outside air system 30 and combustion chamber closure assembly 20 are arranged and constructed to deliver air for the burning fuel in combustion chamber 12', the air being delivered either through a room air mode position or an outside air mode position of the outside air system 30 such as is described hereinbefore for FIGS. 1 through 12.

In operation fireplace 10' conducts air to be heated through air conducting assembly 110. Air conducting assembly 110 includes a conduit coupled to heat exchanger 100 so that the air to be heated enters through the bottom section of grille 112, 112' and is discharged into the room after being heated through top section of grille 114, 114'. The air conducting and the heat exchanger assemblies are described fully in the aforementioned patent application. Outside air system 30 and combustion chamber closure assembly 20 operated independently of the heat circulating fireplace and provides either room air or outside air for the burning of fuel in combustion chamber 12' of fireplace 10'. Thus, in the embodiment shown in FIGS. 12 and 13, heat energy which normally would be expelled to the outside atmosphere via the chimney flue is returned to the room in the form of heated air.

The present invention while described in a preferred form of a prefabricated fireplace, the invention may be utilized in other fireplace designs such as mobile homes, or masonry fireplace designs including heat circulating means for returning heated air to a room or rooms without affecting the operation of the present invention. Many substitutions of materials, change of design of one or more of the components may be had without detracting from the invention as described.

What is claimed is:

1. An outside air supply system and combustion chamber closure assembly including a frame for removably mounting in surrounding relation with the vertical walls, top wall and hearth forming the combustion chamber opening and at least one door operably mounted thereto;

air passage means formed in the frame at hearth level for introduction of air into the combustion chamber;

an outside air system including an outside air duct which is coupled to a chamber defining an air plenum formed below the hearth of the fireplace and an air cap assembly extending across the combustion chamber opening in fluid communication with said air passage means formed in said frame and said chamber defining the air plenum formed below the hearth;

said air cap assembly including an air discharge housing having a top wall, opposed side walls and a vertical louvered wall coupled to said top wall;

damper means, operably mounted in the air cap assembly and being adjustable between an outside air mode position and a room air mode position so that when said at least one door is closed, only outside air or room air will be introduced into the combustion chamber at hearth level whereby said air supply is sufficient for fuel combustion while providing an excess of air which flows upwardly between the burning fuel and the closure assembly; and said damper means being pivotally mounted in said housing to cover the louvered vertical wall of said air cap housing when in said outside air mode position and to cover the air plenum when in said room air mode position.

2. The outside air system and combustion chamber closure assembly of claim 1 wherein said air cap assembly includes a duct mounted between the chamber defining an air plenum at one end thereof and the air discharge housing, an ash filter basket removably mounted on said duct and having an opening adjacent its lower end and a screen covering said opening to provide a container to hold debris from the combustion chamber.

3. The outside air system and combustion chamber closure assembly of claim 1 wherein said outside air duct includes an outside air cap mounted at its open outer end and being positioned up to ten feet from the hearth.

4. The outside air system and combustion chamber closure assembly of claim 1 wherein said closure assembly includes a frame adapted to be mounted in the opening of the combustion chamber and having a plurality of glass doors hingedly mounted thereon, said frame including a louvered bottom frame member extending the width of the combustion chamber so that air is introduced into the combustion chamber at hearth level.

5. A prefabricated fireplace assembly for mounting in a structure comprising:

a combustion chamber having an open front and a hearth;

a closure assembly including a frame surrounding the combustion chamber opening and at least one door operably mounted thereto;

air passage means formed in the frame at hearth level for introduction of air into the combustion chamber;

an outside air system including an outside air duct which is coupled to a chamber defining an air plenum formed below the hearth of the fireplace and air cap assembly extending across the combustion chamber opening and is in fluid communication with said air passage means formed in said frame and said chamber defining the air plenum formed below the hearth;

said air cap assembly including an air discharge housing having a top wall, opposed side walls and a vertical louvered wall coupled to said top wall;

damper means, operably mounted in the air cap assembly, and being adjustable between an outside air mode position or a room air mode position so that when said at least one door is closed, only outside air or room air will be introduced into the combustion chamber at hearth level whereby said air supply is sifficient for fuel combustion while providing an excess of air which flows upwardly between the burning fuel and the closure assembly to maintain safe fireplace temperatures and to protect said at least one door from damage by radiant heat generated by the burning fuel; and said damper means being pivotally mounted in said housing to cover the louvered vertical wall of said air cap housing when in said outside air mode position and to cover the air plenum when in said room air mode position.

6. The prefabricated fireplace assembly of claim 5 wherein said air cap assembly includes a duct mounted between the chamber defining an air plenum at one end thereof and the air discharge housing, an ash filter basket removably mounted on said duct, and having an opening adjacent its lower end and a screen covering said opening to provide a container to hold debris from the combustion chamber.

7. The prefabricated fireplace assembly of claim 6 wherein said outside air duct includes an outside air cap mounted at its open outer end and being positioned up to ten feet above the hearth.

8. The prefabricated fireplace assembly of claim 7 wherein said closure assembly includes a frame to be mounted in the opening of the combustion chamber and having a plurality of glass doors hingedly mounted thereon, said frame including a louvered bottom frame member extending the width of the combustion chamber so that air is introduced into the combustion chamber at hearth level.

* * * * *